US005609697A

United States Patent [19]

Moinard et al.

[11] Patent Number: 5,609,697

[45] Date of Patent: Mar. 11, 1997

[54] PROCESS FOR THE PRODUCTION OF A TUBULAR ZIRCALOY 2 BLANK INTERNALLY CLAD WITH ZIRCONIUM AND SUITABLE FOR ULTRASOUND MONITORING OF THE ZIRCONIUM THICKNESS

[75] Inventors: Philippe Moinard, Montreuil-Juigné ; Yvon Millet, Beaucouzé, both of France

[73] Assignee: Compagnie Europeene du Zirconium Cezus, Courbevoie, France

[21] Appl. No.: 399,555

[22] Filed: Mar. 7, 1995

[30] Foreign Application Priority Data

Mar. 24, 1994 [FR] France ..... 92 03724

[51] Int. Cl.[6] ..... C22F 1/18

[52] U.S. Cl. ..... 148/519; 148/672

[58] Field of Search ..... 148/519, 527, 148/672

[56] References Cited

U.S. PATENT DOCUMENTS

| | | | |
|---|---|---|---|
| 4,294,631 | 10/1981 | Anthony et al. | 148/565 |
| 4,390,497 | 6/1983 | Rosenbaum et al. | 148/519 |
| 4,671,826 | 6/1987 | Prizzi | 148/672 |
| 5,223,206 | 6/1993 | Rosenbaum | 148/672 |

FOREIGN PATENT DOCUMENTS

| | | | |
|---|---|---|---|
| 2172737 | 9/1986 | United Kingdom . | |
| 94-15343 | 7/1994 | WIPO | 148/527 |

*Primary Examiner*—George Wyszomierski
*Attorney, Agent, or Firm*—Dennison, Meserole, Pollack & Scheiner

[57] ABSTRACT

The invention concerns a process for the production of a tubular zircaloy 2 blank which is internally clad with zirconium for use in producing composite cladding tubes for nuclear fuel. The internal zirconium cladding is rendered suitable for ultrasound monitoring of its thickness by an appropriate thermomechanical treatment which takes place during one or more of the production steps for said blank. The aim is to adjust the grain size to an ASTM index of between 9 and 12 for the zircaloy 2 and between 6 and 10 for the unalloyed zirconium, retaining a grain size difference between the zircaloy 2 and the unalloyed zirconium of at least 2 ASTM index numbers.

15 Claims, 5 Drawing Sheets

PROCESS FOR THE PRODUCTION OF A TUBULAR ZIRCALOY 2 BLANK INTERNALLY CLAD WITH ZIRCONIUM AND SUITABLE FOR ULTRASOUND MONITORING OF THE ZIRCONIUM THICKNESS

TECHNICAL FIELD

The invention concerns a process for the production of a tubular zircaloy 2 blank internally clad with zirconium for the production of composite cladding tubes for nuclear fuel. The internal zirconium cladding constitutes a barrier against fission products and hydrogen generated in the fuel which embrittle the external zircaloy 2 sleeve. Thus the thickness of this cladding must be precisely and reproducibly monitored.

PRIOR ART

The regularity of the thickness of the internal zirconium layer of composite Zy2/Zr cladding tubes for nuclear fuel is an essential feature which must therefore be systematically monitored with great accuracy for each cladding tube and for each composite tubular blank from which it is formed.

To this end, non destructive industrial monitoring techniques which are deemed to be accurate and reliable, but also easy and quick to use, have to be used, involving monitoring the thickness of the internal zirconium cladding in each composite tubular blank along the whole of its length.

Thickness monitoring methods using eddy currents have thus been employed, see in particular M IWASAKI, N SUZUKI, Y NISHIMOTO, M KOTAN and N FUJII in NUCLEAR ENGINEERING AND DESIGN 94, (1986), pp 447–452. These methods are suitable for measuring thicknesses of several tenths of millimeters of composite cladding tubes but become imprecise and thus unsuitable for thicknesses of 1 mm and more. In the present case, they do not cover the whole range of thicknesses of internal Zr cladding for composite cladding tube blanks which can vary from 0.5 mm to 1.5 mm or 2 mm.

Although ultrasound thickness monitoring methods for composite Zr alloy/Zr cladding tubes have long been considered too inaccurate because the difference in acoustic impedance between the zirconium and the zirconium alloy is too low, substantial progress has recently been made in this field:

- either by accentuating the effect of the interface in the material by creating an intermediate layer based on graphite and methyl cellulose between the two layers in accordance with Japanese patent JP-A-58 199 139. This, however, often requires the manufacturing conditions to be considerably modified, risking altering some of the properties of the product or simply increasing production costs;
- or improving the precision and reproducibility of the ultrasonic measurements themselves using more suitable means such as those described in European patent EP-A-0 429 854, U.S. Pat. No. 4,992,1440 and particularly EP-B-0 335 808 which recommends ultrasonic monitoring of the thickness of the internal cladding from outside the tube using a highly damped focussing transducer, with a principal resonance frequency of between 4 and 20 MHz, used in reflection emission mode and provided with electronic means for detecting at least one double echo from the tube cladding/core interface, and using independent means for positioning and orienting with respect to the tube to be checked and means for reporting this position for successive tubes of the same type.

These improvements, while increasing the sensitivity of ultrasonic thickness measurements of the internal Zr cladding in composite Zr alloy/Zr tubes, have been shown still to be unsuitable for accurate and reliable determination of the thickness of the Zr cladding in composite zircaloy 2/Zr tubes because the relative difference between the acoustic impedances of zircaloy 2 and Zr remains less than 2%. This is particularly the case for tubular blanks and composite tubes produced using the process described in French patent FR-A-2 579 122 which recommends grain refining the internal Zr cladding to improve its surface quality by regulating the iron content in the Zr ingot to between 250 and 1000 ppm, combined with water quenching the billets produced from the worked Zr ingot from a temperature of between 880° C. and 1050° C.

During dynamic circumferential exploration of the tubular blank or composite tube using the process described in EP-B-0 335 808, the poor quality of the ultrasound signal observed is transformed into signal losses in the zones where the thickness measurements cannot be made for this reason.

AIM OF THE INVENTION

Working from the experimental fact that the reliability of ultrasound measurements of the thickness of the Zr cladding in tubular blanks, in particular those obtained using the process described in FR-A-2 579 122 described above, is a function of the metallurgical parameters which closely depend on the method of manufacture, we have researched and developed a process for the production of tubular zircaloy 2 blanks internally clad with zirconium in which the thickness of the zirconium can be monitored ultrasonically.

More precisely, the invention concerns a process for the production of a composite tubular blank of zircaloy 2 internally clad with zirconium comprising the following main steps of the prior art:

a) water quenching a worked zircaloy 2 bar from the beta phase, before or after cutting into bored or solid billets, optionally followed by annealing;

b) water quenching an unalloyed zirconium billet with an iron content of between 250 and 1000 ppm, before or after boring, from a temperature of between 880° C. and 1050° C.;

c) extruding the zirconium billet in the alpha phase into the form of a tube;

d) positioning and assembling the zirconium tube in the bored zircaloy 2 billet;

e) extruding the assembly obtained in the alpha phase into the form of a composite extruded blank;

f) cold rolling and heat treating the composite extruded blank to produce a composite tubular blank constituting the composite Zy2/Zr cladding tube, characterised in that, by means of appropriate thermomechanical treatment of the worked zircaloy 2 bar in the alpha phase after water quenching from the beta phase, and/or of the quenched and optionally annealed and bored zircaloy 2 billet and/or of the unalloyed zirconium billet after extruding in the alpha phase into tube form and/or of the composite tubular blank after cold rolling, the grain size is adjusted to an ASTM index of between 9 and 12 for the zircaloy 2 and between 6 and 10 for the unalloyed zirconium of said composite blank, maintaining a grain size difference ΔI between the zircaloy 2 and the unalloyed zirconium of at least 2 ASTM index numbers.

Metallurgical examinations carried out on different samples subjected to the same ultrasound monitoring conditions have shown that the difficulties in obtaining a good quality ultrasound signal were, among others, a function of the regularity of the Zy2/Zr interface and especially of the difference in grain size between the external zircaloy 2 component and the internal zirconium component. Using a series of composite zircaloy 2/zirconium tubular blanks (produced in accordance with FR-A-2 579 122 cited above) with an internal zirconium cladding containing 250 to 1000 ppm of iron, we thus established that only 30% of the thickness measurements for said internal cladding could be used. In fact, the number of deviant measurements corresponded generally to reflection anomalies at the interface, randomly distributed along the length or each tubular blank. During monitoring, each point on the surface describes a helix whose pitch is defined by the speed of rotation and advance of the blank. Thus, under the monitoring conditions described in EP-B-0 335 808 using a transducer which is energized to a frequency of 1 kHz, the tubular blanks being moved at a rotational speed of 250 rpm and advanced at 1 m/min, producing a helix with a pitch of 4 mm, 240 measurements per turn of the helix can in theory be collected, but only 72 measurements can be used with a precision of ±5 μm on the thickness measurement.

We have also determined that an ASTM grain index of 10 for the external zircaloy 2 sleeve and 10 for the internal zirconium sleeve or cladding corresponds to an ASTM index difference of zero, i.e., ΔI=0.

During production of composite Zy2/Zr tubular blanks in accordance with the prior art, in particular FR-A 2 579 122, we have defined four possible modifications to the operating method, which can be carried out independently of each other or in combination. All of these can change certain metallurgical characteristics, in particular the grain size of the internal and external components of the composite blank, to render these components suitable for ultrasound thickness monitoring. These modifications, which use novel heat and/or mechanical treatments without altering the properties of the final product, will be better understood from the following detailed description.

DETAILED DESCRIPTION OF THE INVENTION

Figure 1:
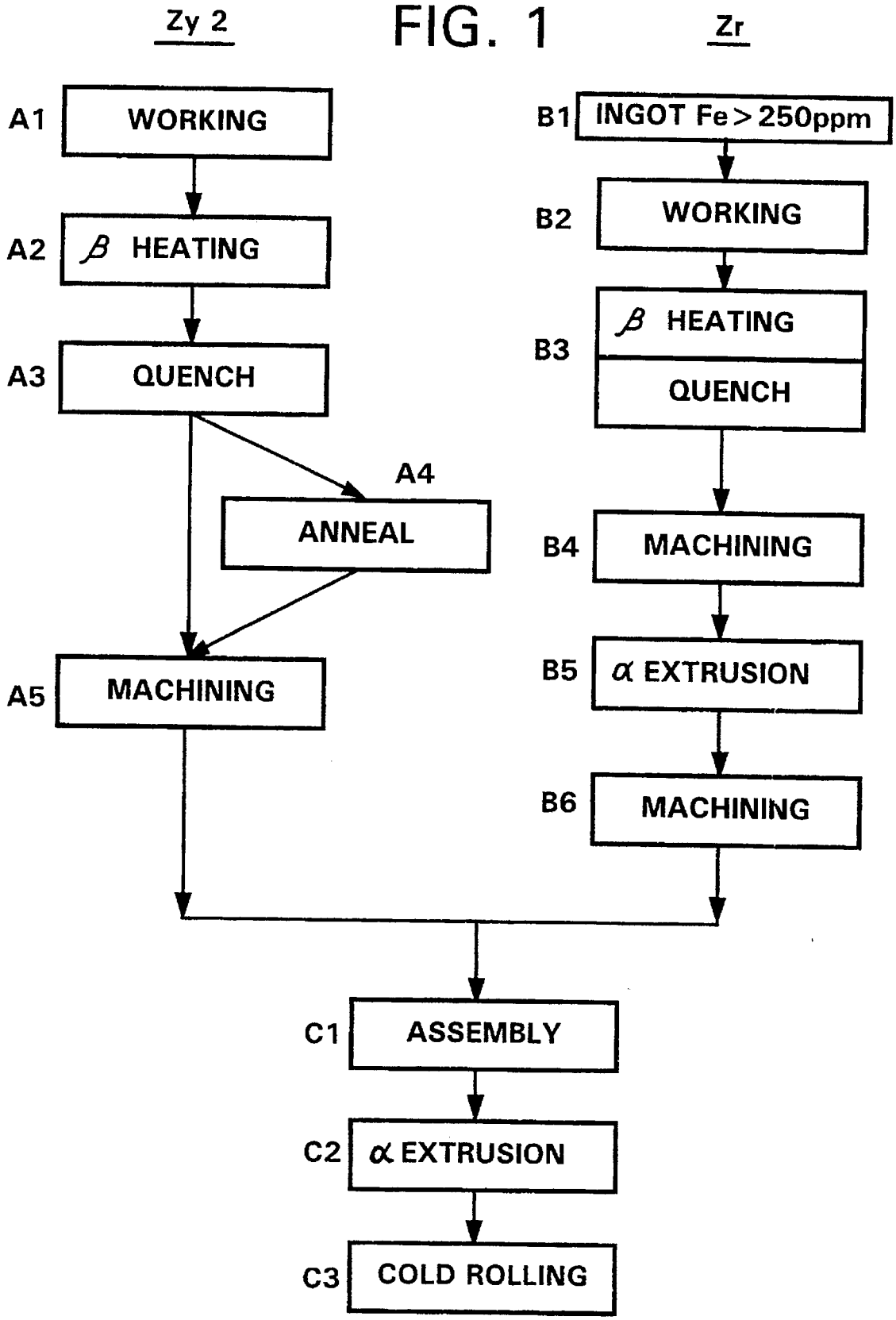
FIG. 1 shows a schematic representation of the steps of the closest prior art process.

In the prior art (FIG. 1), the external zircaloy 2 component was obtained after working at A1 of a solid Zy2 bar to a diameter of 177 mm (150 mm $\leqq\bar{\phi}\leqq$200 mm) which, after heating at A2 for one hour at 1050° C., was quenched at A3, annealing at A4 for 3 to 5 hours between 750° C. and 780° C. being optional. After cutting the bar into billets, these were machined at A5 and bored ($\bar{\phi}_e$=168 mm, $\bar{\phi}_i$=78.8 mm).

The unalloyed zirconium internal component was produced in parallel by taking a zirconium ingot with an iron content of between 250 and 1000 ppm which had been vacuum smelted at B1 and worked at B2. After cutting the forged bar into billets of diameter 172 mm (150$\leqq\bar{\phi}\leqq$200 mm), these were reheated to between 880° C. and 1050° C. and quenched at B3 then machined at B4 ($\bar{\phi}_e$=168 mm; $\bar{\phi}_i$=51 mm) before being extruded into tubes at B5 in the alpha phase to diameters $\bar{\phi}_e$=82 mm and $\bar{\phi}_i$=47 mm; each tube was machined to $\bar{\phi}_e$=78.8 mm and $\bar{\phi}_i$=48 mm before positioning for assembly at C1 in the substantially coaxial hole in the bored and machined zircaloy 2 billet.

The assembly formed at C1 was then extruded at C2 in the alpha phase, preferably at about 600° C., to produce a composite extruded blank ($\bar{\phi}_e$=80 mm; $\bar{\phi}_i$=48 mm) which was cold rolled at C3 to $\bar{\phi}_e$=63.5 mm and $\bar{\phi}_i$=41.5 mm to produce a composite tubular blank which could then undergo any final optional heat treatment. Under these conditions, and as indicated above, only 30% of the measurements of the internal zirconium cladding thickness could be used.

Figure 2:
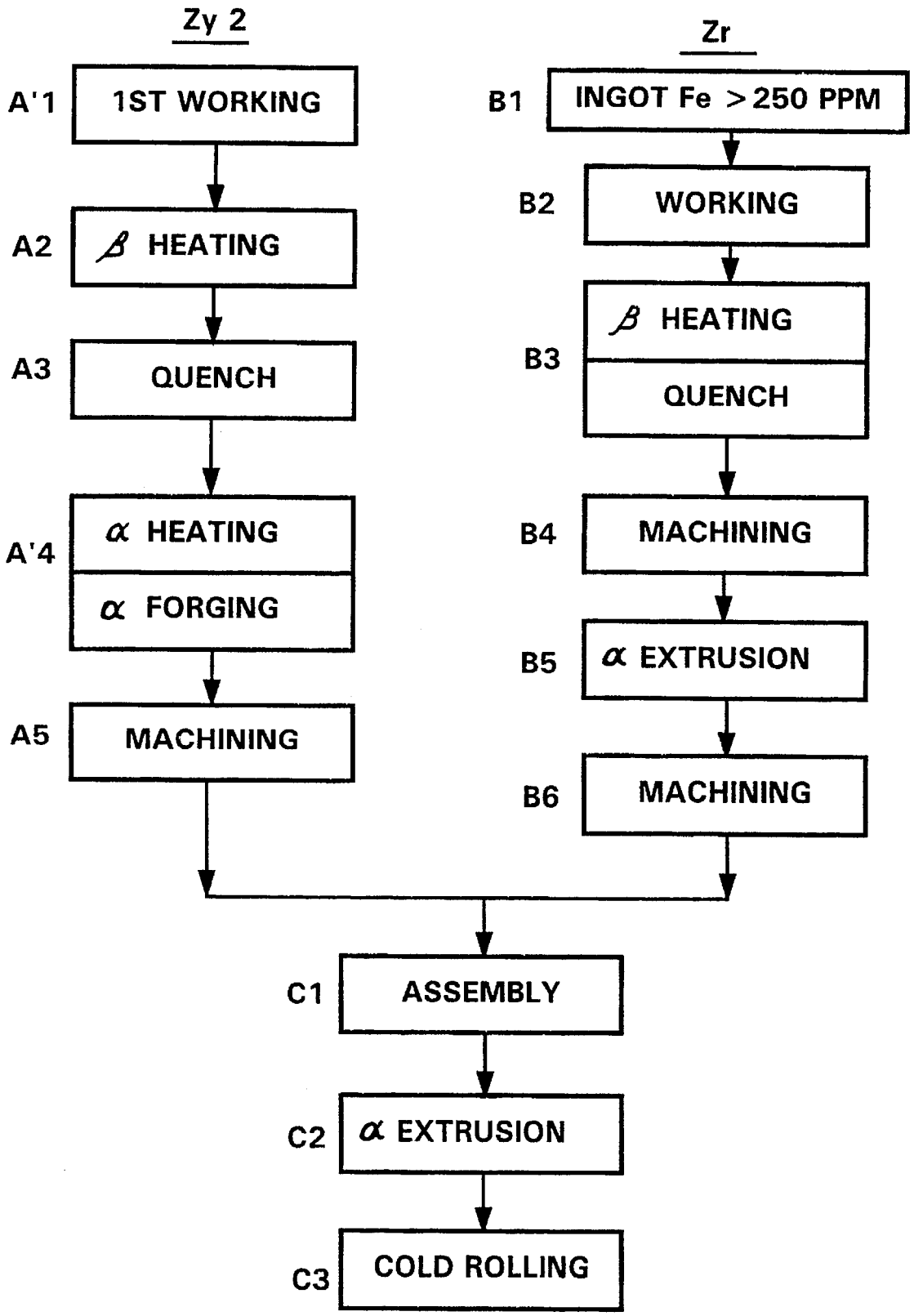
FIG. 2 shows a schematic representation of the same process including an embodiment of the invention consisting of complementary forging in the alpha phase of the zircaloy 2 bar following quenching.

A first embodiment to improve the regularity of the Zy2/Zr interface, in particular to create a difference in grain size ΔI of at least 2, is shown in FIG. 2. It consists in working the zircaloy 2 bar in the alpha phase after quenching at A3 to provoke substantial grain refining of the zircaloy 2 at the blank stage which is retained after assembly at C1, extruding at C2 and rolling at C3 of the composite tubular blank, significantly regularizing the Zy2/Zr interface.

More precisely, after heating at A2 for 1 hour at 1050° C. (1030° C. to 1070° C.), a bar which had been worked by forging or rolling at A'1 to a diameter of about 300 mm (250 to 350 mm) rather than the 177 mm (150 to 200 mm) of the prior art, was alpha quenched. After heating for 3 to 5 hours between 750° C. and 780° C., the diameter of the bar was reduced to $\bar{\phi}$=177 mm by forging in the alpha phase at A4 before cutting, machining and boring the billets at A5 for assembly at C1 and transformation in accordance with the prior art.

ASTM grain size measurements showed the following:

| | | |
|---|---|---|
| For the internal unalloyed Zr cladding, | I1 = | 10; |
| for the external Zy2 sleeve, | I2 = | 12; |
| i.e., a difference | ΔI = | 2 ASTM index numbers. |

At the same time, ultrasound measurements of the thickness of the internal cladding on a series of 10 composite Zy2/Zr tubular blanks made in this fashion indicated an average of 218 usable measurements with a dispersion of ±5% from a theoretical total of 240 measurements per helical turn under the measurement conditions described above (see Table 1).

Figure 3:
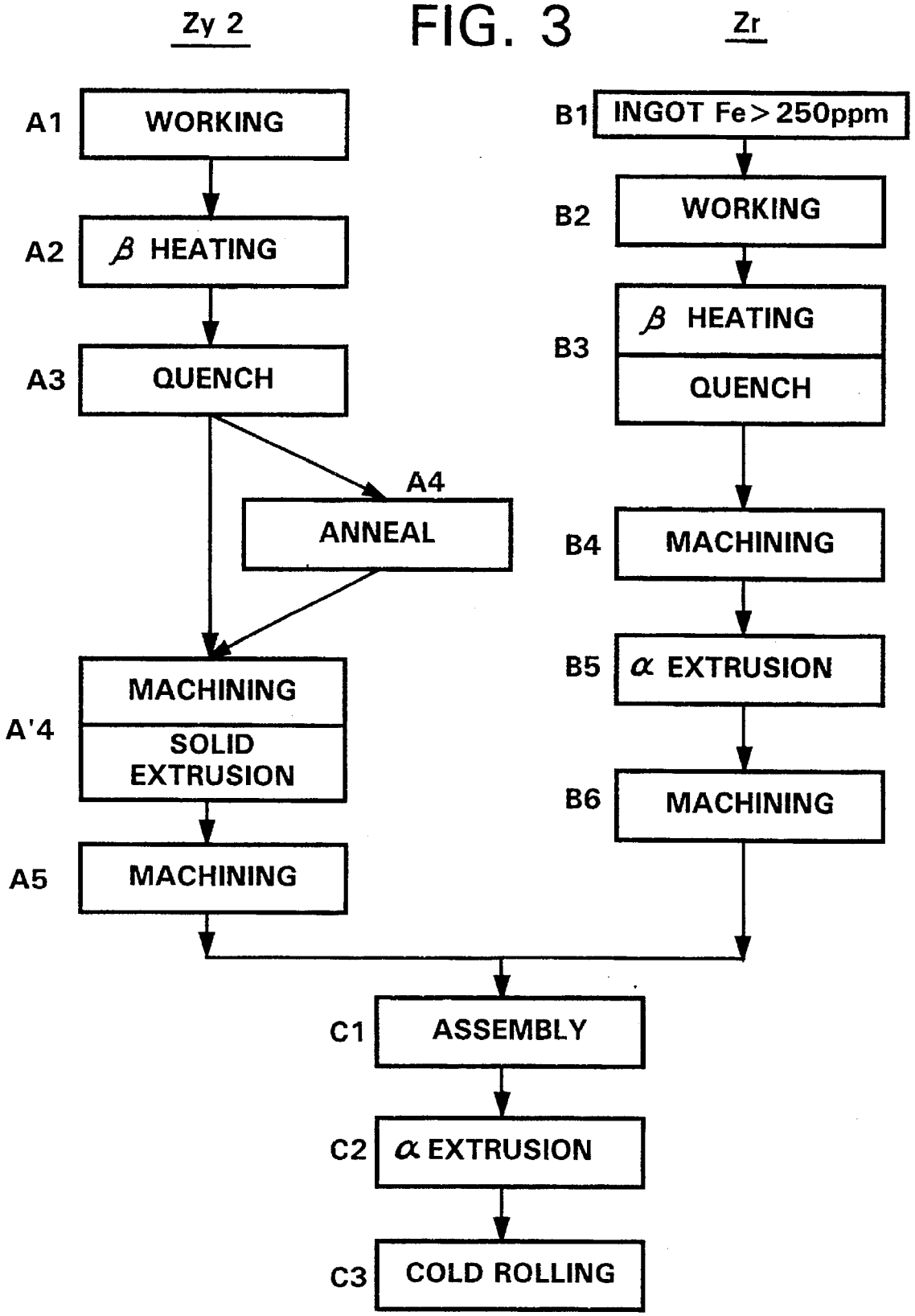
FIG. 3 shows a schematic representation of the same process including a second embodiment of the invention, consisting of boring the zircaloy 2 billet after quenching by solid extrusion, for example using the process described in FR-A-2 685 881.

The second embodiment, shown in FIG. 3, also significantly improves the regularity of the Zy2/Zr interface of composite tubular blanks and in particular produces a ΔI$\leqq$2.

This consists in acting on the grain size of solid or prebored zircaloy 2 billets after quenching at A3 and optional annealing at A4 by carrying out a boring operation by solid extrusion at A'4 between 400° C. and 600° C. using the process described in FR-A-2 685 881 relating to the production of duplex and triplex zirconium based tubes. That process recommends the use of conventional solid extrusion to extrude and upset the zirconium or zirconium alloy billet to improve and regularize the structure of the inner surface of the tubular element.

In the present case, however, we established by experiment that the regularity of the interface was strictly dependent on the micrographic stuctures of the 2 components of the assembly before extruding and that the resulting interface of said assembly was more irregular when the needles of ex beta phase from quenching the zircaloy 2 from the beta phase were larger. Extruding with upsetting of the quenched or optionally annealed Zy2 billets resulted in particularly effective working of the internal face of the Zy2 blank which was to be placed in contact with the external face of the unalloyed tubular Zr blank. The acicular beta to alpha quenched transformation structure was broken up and the average Zy2 grain size was reduced as a result, smoothing the irregularities of the interface.

Thus, from quenched billets machined to $\bar{\phi}_e$=168 mm and prebored to $\bar{\phi}_i$=25 mm, after solid extrusion at A'4 at 500° C., a Zy2 blank with $\bar{\phi}_e$=172 mm and $\bar{\phi}_i$=70 mm was obtained which, after machining again at A5, resulted in $\bar{\phi}_e$=168 mm and $\bar{\phi}_i$=78 mm. This was assembled with the tubular low iron zirconium blank at C1 then extruded at C2 and cold rolled at C3 in accordance with the prior art.

| | | |
|---|---|---|
| For the internal unalloyed Zr cladding, | I1 = | 10; |
| for the external Zy2 sleeve, | I2 = | 12; |
| i.e., a difference | ΔI = | 2 ASTM index numbers. |

At the same time, ultrasound measurement of the thickness of the internal cladding on a series of 10 composite tubular blanks made in this fashion indicated an average of 204 usable measurements from a theoretical total of 240 with a dispersion of ±5% (see Table 1).

Figure 4:
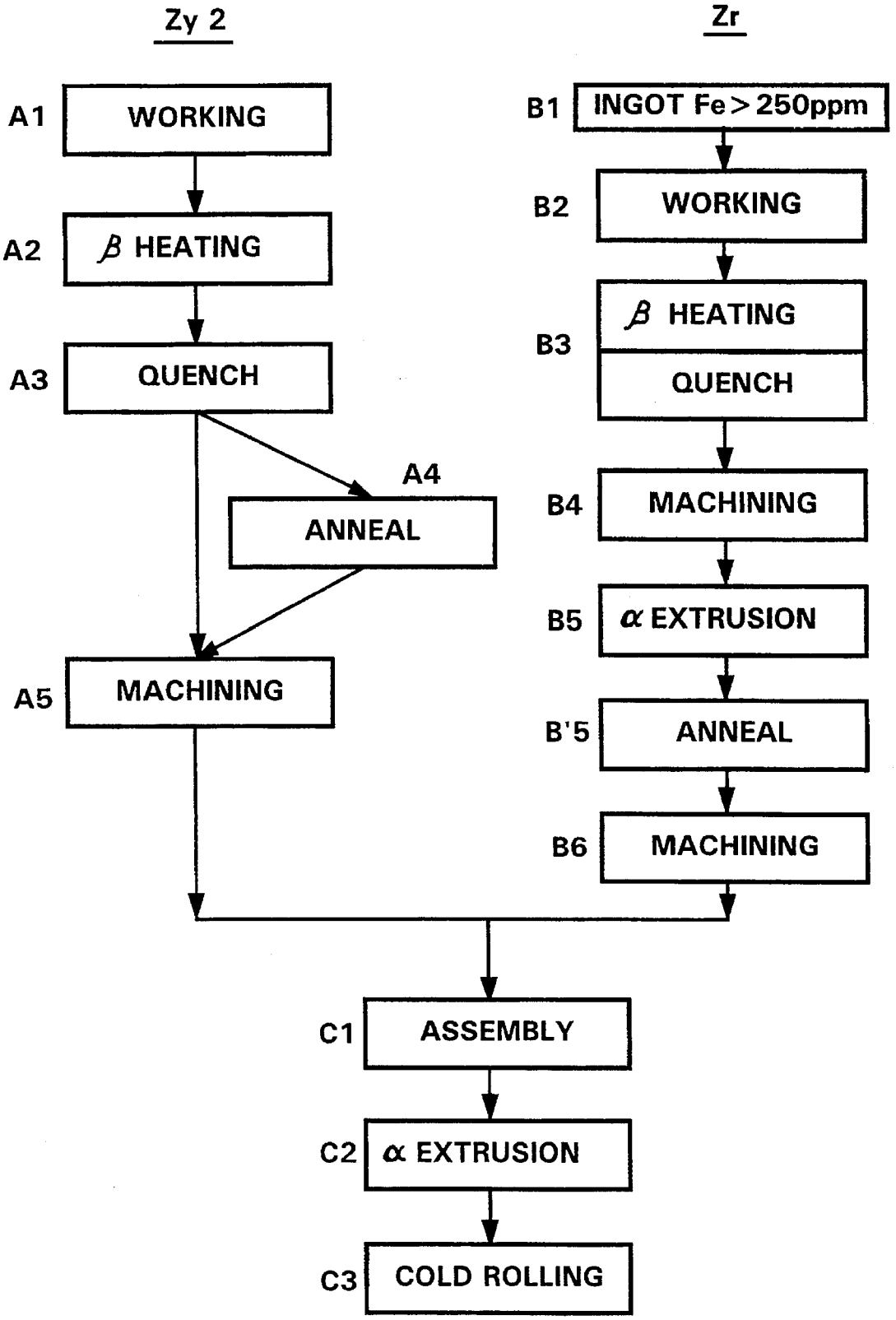
FIG. 4 shows a schematic representation of the same process including a third embodiment consisting of carrying out recrystallization heat treatment on the unalloyed zirconium billet after extruding in the alpha phase.

A third embodiment, shown in FIG. 4, also produced highly acceptable accuracy and reproducibility of measurements and consists in specifically favouring grain enlargement in the unalloyed zirconium blank during its production using a specific recrystallization heat treatment at B'5 for the tubular zirconium blank after extruding in the alpha phase at B5. This heat treatment was carried out at a temperature of 500° C. to 780° C. for 1 hour to 4 hours, preferably at 730° C. for 3 hours, to enlarge the grain size to an ASTM index of 4 to 6.

During the subsequent extruding operation at C2 and cold forging at C3 for the composite tubular blank in accordance with the prior art, substantial grain refining occurred in the zirconium of the internal cladding, where the grain size index reached 7 while the grain size index for the external Zy2 sleeve remained stable at 10, giving an index difference ΔI=3.

At the same time, ultrasound measurements of the thickness of the internal Zr cladding on a series of 10 tubular blanks made in this fashion indicated an average of 209 usable measurements from a theoretical total of 240 with a dispersion of ±5% about this average (see Table 1).

Figure 5:
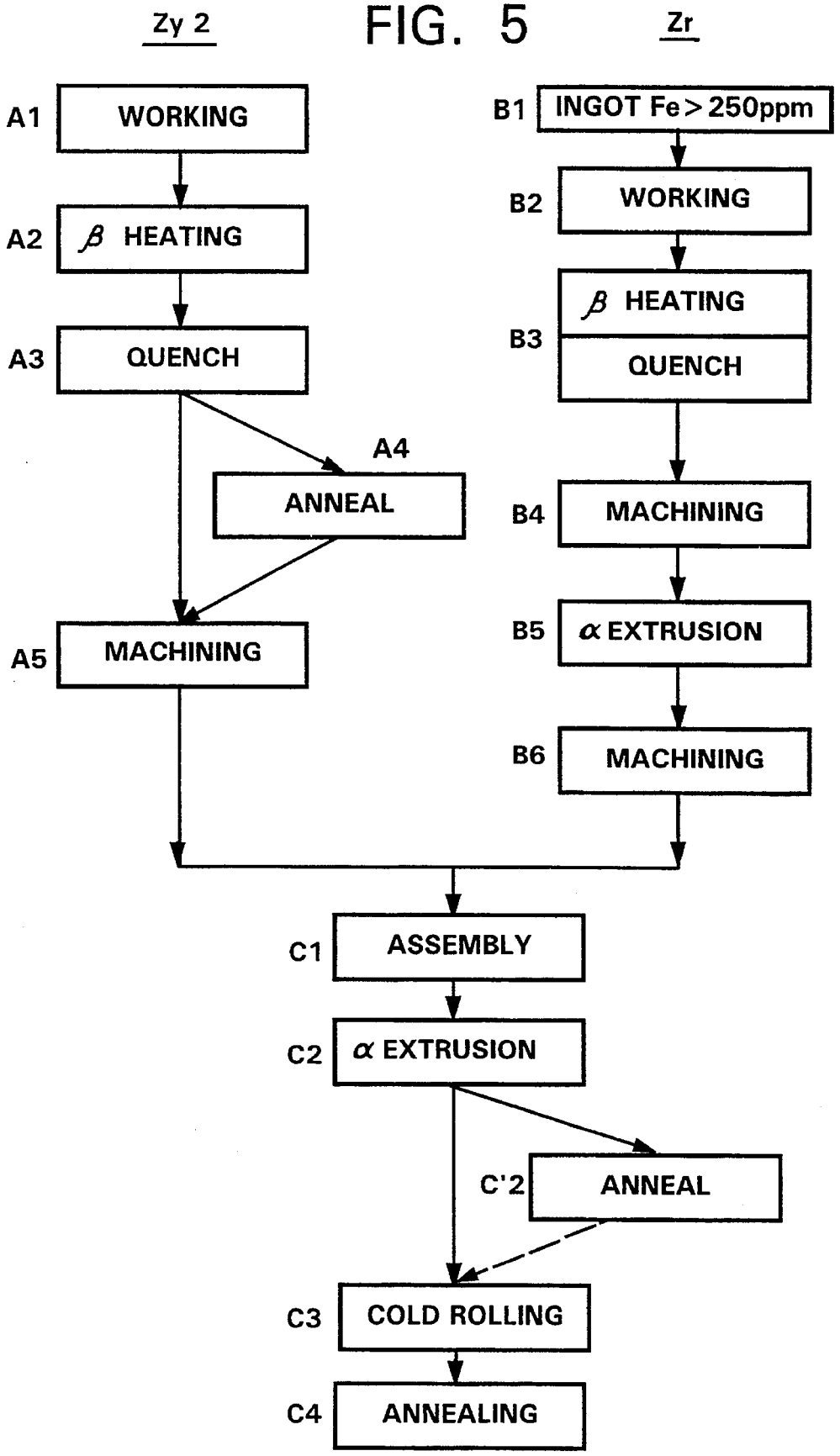
FIG. 5 shows a schematic representation of the same process including a fourth embodiment of the invention, consisting of carrying out at least one recrystallization heat treatment on the composite tubular blank.

A fourth embodiment is shown in FIG. 5 and is a little less effective but easy to carry out on an industrial scale. It consists in carrying out, on the composite tubular blank, either recrystallization annealing at C'2 after assembly at C1 and extruding at C2 in accordance with the prior art, or carrying out recrystallization annealing at C4 after assembly at C1 and extruding at C2, optional recrystallization annealing at C'2 and rolling at C3. Recrystallization annealing at C'2 and/or C4 is carried out under conditions, generally 1 to 3 hours between 700° C. and 730° C., such that the internal zirconium cladding had a grain size index of at least 7, preferably 8, retaining a grain size index of at least 9, preferably 10, in the external zircaloy 2 sleeve, giving an index difference ΔI≦2.

Ultrasound measurements of the thickness of the internal Zr cladding on a series of 10 composite tubular blanks made in this fashion indicated an average of 204 usable measurements from a theoretical total of 240 with a dispersion of ±5% (see Table 1).

It should be noted that these different embodiments act on different stages of the basic process and can be combined with each other to contribute to the increase in the number and thus the percentage of readable measurements and thus to the improvement in the reliability of the ultrasound measurements of the thickness of the internal unalloyed zirconium cladding as shown in Table 1 below.

It should, however, be noted that the most effective combinations are binary combinations using specific working of the external Zy2 sleeve (first or second embodiment) with recrystallization heat treatment (third or fourth embodiment).

TABLE 1

SUMMARY OF RESULTS

| Process type | Number of readable measurements | Readable measurement, % | I2 ASTM Zy2 | I1 ASTM Zr | ΔI (I2 − I1) |
|---|---|---|---|---|---|
| Prior art | 72 | 30 | 10 | 10 | 0 |
| 1st embdt | 218 | 91 | 12 | 10 | 2 |
| 2nd embdt | 204 | 85 | 12 | 10 | 2 |
| 3rd embdt | 209 | 87 | 10 | 7 | 3 |
| 4th embdt | 204 | 85 | 9 | 7 | 2 |
| 1st + 2nd | 225 | 94 | 12 | 10 | 2 |
| 1st + 3rd | 230 | 96 | 12 | 7 | 5 |
| 1st + 4th | 225 | 94 | 12 | 8 | 4 |
| 2nd + 3rd | 228 | 95 | 12 | 7 | 5 |
| 2nd + 4th | 226 | 94 | 11 | 7 | 4 |
| 1st + 3rd + 4th | 220 | 92 | 11 | 7 | 4 |
| 2nd + 3rd + 4th | 218 | 91 | 10 | 7 | 3 |

We claim:

1. In a process for the production of a composite tubular blank of zircaloy 2 internally clad with zirconium comprising:

a) water quenching a worked zircaloy 2 bar from the beta phase, optionally followed by annealing, before cutting into billets that are machined and bored;

b) water quenching, from a temperature of between 880° C. and 1050° C., an unalloyed zirconium billet with an iron content of between 250 and 1000 ppm, before machining and boring;

c) extruding the zirconium billet in the alpha phase into the form of a tube;

d) positioning and assembling the zirconium tube in the bored zircaloy 2 billet, to form an assembly;

e) extruding the assembly into the form of a composite extruded blank;

f) cold rolling and heat treating the composite extruded blank to produce a composite tubular blank, the improvement comprising, after said water quenching of the zircaloy 2 bar and before said cutting into billets, working said bar in the alpha phase by forging after heating for 3 to 5 hours at between 750° and 780° C. such that the zircaloy 2 has its grain size adjusted to an ASTM index of between 9 and 12, wherein the unalloyed zirconium has its grain size at an ASTM index of between 6 and 10, the grain size index difference ΔI between the zircaloy 2 and the unalloyed zirconium being at least 2 ASTM index numbers.

2. A process according to claim 1, wherein the improvement further comprises boring said zircaloy 2 billet by solid extrusion in the alpha phase with an extruding and upsetting press at between 400° and 600° C.

3. A process according to claim 1, wherein the improvement further comprises, after extruding said zirconium billet into the form of a tube, performing a recrystallization heat treatment of said tube at a temperature of 500° to 780° C. for 1 to 4 hours in order to adjust the zirconium to an ASTM grain size index of between 6 and 10.

4. A process according to claim 3, wherein the improvement further comprises, after cold rolling of the composite tubular blank, performing a recrystallization heat treatment of said composite tubular blank for 1 to 3 hours at between 700° and 730° C.

5. A process according to claim 4, wherein said grain size index of the zircaloy 2 is adjusted to 11 or 12 and said grain size index of the unalloyed zirconium is adjusted to 7 or 8.

6. A process according to claim 3, wherein said grain size index of the zircaloy 2 is adjusted to 11 or 12 and said grain size index of the unalloyed zirconium is adjusted to 7 or 8.

7. A process according to claim 1, wherein the improvement further comprises, after cold rolling of the composite tubular blank, performing a recrystallization heat treatment of said composite tubular blank for 1 to 3 hours at between 700° and 730° C.

8. A process according to claim 7, wherein said grain size index of the zircaloy 2 is adjusted to 11 or 12 and said grain size index of the unalloyed zirconium is adjusted to 7 or 8.

9. In a process for the production of a composite tubular blank of zircaloy 2 internally clad with zirconium comprising:

a) water quenching a worked zircaloy 2 bar from the beta phase, optionally followed by annealing, before cutting into billets and machining and optionally preboring said billets;

b) water quenching, from a temperature of between 880° C. and 1050° C., an unalloyed zirconium billet with an iron content of between 250 and 1000 ppm, before machining and boring;

c) extruding the zirconium billet in the alpha phase into the form of a tube;

d) positioning and assembling the zirconium tube in the bored zircaloy 2 billet, to form an assembly;

e) extruding the assembly into the form of a composite extruded blank;

f) cold rolling and heat treating the composite extruded blank to produce a composite tubular blank, the improvement comprising, after said machining and optional preboring, boring said zircaloy 2 billet by solid extrusion in the alpha phase with an extruding and upsetting press at between 400° and 600° C., and after said water quenching of said billet, the zircaloy 2 having its grain size adjusted to an ASTM index of between 9 and 12, wherein the unalloyed zirconium has its grain size at an ASTM index of between 6and 10, the grain size index difference ΔI between the zircaloy 2 and the unalloyed zirconium being at least 2 ASTM index numbers.

10. A process according to claim 9, wherein the improvement further comprises, after extruding said zirconium billet into the form of a tube, performing a recrystallization heat treatment of said tube at a temperature of 500° to 780° C. for 1 to 4 hours in order to adjust the zirconium to an ASTM grain size index of between 6 and 10.

11. A process according to claim 10, wherein the improvement further comprises, after cold rolling of the composite tubular blank, performing a recrystallization heat treatment of said composite tubular blank for 1 to 3 hours at between 700° and 730° C.

12. A process according to claim 10, wherein said grain size index of the zircaloy 2 is adjusted to 11 or 12 and said grain size index of the unalloyed zirconium is adjusted to 7 or 8.

13. A process according to claim 9, wherein the improvement further comprises, after cold rolling of the composite tubular blank, performing a recrystallization heat treatment of said composite tubular blank for 1 to 3 hours at between 700° and 730° C.

14. A process according to claim 13, wherein said grain size index of the zircaloy 2 is adjusted to 11 or 12 and said grain size index of the unalloyed zirconium is adjusted to 7 or 8.

15. In a process for the production of a composite tubular blank of zircaloy 2 internally clad with zirconium comprising:

a) water quenching a worked zircaloy 2 bar from the beta phase, optionally followed by annealing, before cutting into billets and machining and boring said billets;

b) water quenching, from a temperature of between 880° C. and 1050° C., an unalloyed zirconium billet with an iron content of between 250 and 1000 ppm, before said machining and boring;

c) extruding the zirconium billet in the alpha phase into the form of a tube;

d) positioning and assembling the zirconium tube in the bored zircaloy 2 billet, to form an assembly;

e) extruding the assembly into the form of a composite extruded blank;

f) cold rolling and heat treating the composite extruded blank to produce a composite tubular blank, the improvement comprising, after cold rolling of the composite tubular blank, performing a recrystallization heat treatment of said composite tubular blank for 1 to 3 hours at between 700° and 730° C., such that said zircaloy 2 has an ASTM grain size index of between 9 and 12 and said unalloyed zirconium has an ASTM grain size index of between 6 and 10, the grain size index difference ΔI between the zircaloy 2 and the unalloyed zirconium being at least 2 ASTM index numbers.

* * * * *